US007942609B2

(12) United States Patent
Koegler

(10) Patent No.: US 7,942,609 B2
(45) Date of Patent: May 17, 2011

(54) METHOD AND DEVICE FOR TRENCHLESS PIPE LAYING

(75) Inventor: Rudiger Koegler, Nordgeorgsfehn (DE)

(73) Assignee: Herrenknecht AG, Schwanau (DE)

( * ) Notice: Subject to any disclaimer, the term of this patent is extended or adjusted under 35 U.S.C. 154(b) by 0 days.

(21) Appl. No.: 12/085,332

(22) PCT Filed: Jan. 19, 2007

(86) PCT No.: PCT/EP2007/000460

§ 371 (c)(1),
(2), (4) Date: May 21, 2008

(87) PCT Pub. No.: WO2007/124789

PCT Pub. Date: Nov. 8, 2007

(65) Prior Publication Data

US 2009/0185866 A1 Jul. 23, 2009

(30) Foreign Application Priority Data

Apr. 28, 2006 (DE) ..... 10 2006 020 339

(51) Int. Cl.
*F16L 1/028* (2006.01)

(52) U.S. Cl. ..... 405/184; 175/61

(58) Field of Classification Search ..... 405/184, 405/154.1, 174; 175/19, 21, 61
See application file for complete search history.

(56) References Cited

U.S. PATENT DOCUMENTS

| | | | | |
|---|---|---|---|---|
| 3,996,758 | A * | 12/1976 | Cherrington | 405/184 |
| 4,003,440 | A | 1/1977 | Cherrington | |
| 4,117,895 | A * | 10/1978 | Ward et al. | 175/53 |
| 4,121,673 | A | 10/1978 | Cherrington | |
| 4,319,648 | A * | 3/1982 | Cherrington | 175/53 |
| 5,984,583 | A * | 11/1999 | Craigmile et al. | 405/184 |
| 2002/0195255 | A1 | 12/2002 | Reilly | |

FOREIGN PATENT DOCUMENTS

| | | |
|---|---|---|
| DE | 6801579 | 4/1973 |
| DE | 196 13 788 | 3/1998 |
| DE | 198 08 478 | 9/1999 |
| DE | 10 2004 014 134 | 10/2005 |
| EP | 1126130 | 8/2001 |
| RU | 2005858 | 1/1994 |
| SU | 1677173 | 9/1991 |
| WO | WO 2006/014417 | 2/2006 |

* cited by examiner

*Primary Examiner* — Tara Mayo-Pinnock

(74) *Attorney, Agent, or Firm* — Mark Rodgers

(57) ABSTRACT

A method for trenchless pipe laying, a pipeline is constructed form a starting point to a goal point undercrossing an obstacle wherein the constructing of a bore hole and laying the prefabricated pipeline, which is constructed in one piece on the surface, are done in one work step, wherein at the front end of the pipeline a steerable drilling device is arranged, wherein a pipe thrusting device is arranged at the starting point applying forces from the outside to the pipeline via traction preferably friction by pushing the pipeline from a starting point to a goal point, wherein at the same time the necessary contact forces for drilling are transferred, wherein the cuttings produced during the drilling by the drilling device are removed and transported hydraulically out of the bore hole via a transport line inside the pipeline, and wherein the annular space between pipeline and bore hole wall created during drilling is continuously filled with a drilling suspension.

3 Claims, 4 Drawing Sheets

6
5
8
2
1
9
3
4
20
7

8
5
9
3
4
6
20
11
12
7

5
9
6
8
20
11
12

6
9
8

6
5
8
2
1
20
7
3
10

8
5
20
11
12
6
3
10

5
20
11
12
8
6
10

6
8
10

METHOD AND DEVICE FOR TRENCHLESS PIPE LAYING

RELATED APPLICATIONS

This application claims priorityto International application PCT/EO 2007/000460, filed Jan. 19, 2007.

BACKGROUND OF THE INVENTION

The present invention relates to a method and a device for trenchless pipe laying underground.

In the past numerous different methods and devices have been developed in order to lay pipes trenchless underground to pass under sensitive surface areas for which pipe laying in an open trench was not possible or was not recommended due to technical, ecological, legal, or economical reasons. This can be the case e.g., where the surface within the laying area can not be driven on by heavy construction machinery (e.g. swamps, waters) or where from a ecological view point no building permit can be given (e.g. in protected areas), or where the application of conventional laying techniques would be too expensive (e.g. in case of large laying depths and high groundwater levels).

In literature there exist comprehensive works of implemented and established methods (z. B. Stein, D., *Grabenloser Leitungsbau,* 2003 Ernst & Sohn Verlag für Architektur und technische Wissenschaften GmbH & Co. KG, Berlin, ISBN 3-433-01778-6). A classification of the procedures may be based on the controllability (steer/uncontrolled procedures), the soil treatment (soil displacement/soil withdrawal), the drill cuttings transport (mechanically, hydraulically), as well as the number of work steps (pilotbore, reaming pass, pull in or pullback step). Further distinguishing features are e.g. the fundamental geometrical forming of the drilling axis (straight-lined, curved) as well as by means of the respective methods for laying different pipe materials (e.g. concrete, polyethylens(PE), casting, steel etc.). In addition also the attainable drilling dimensions (length, diameter, volume) serve to classify the methods.

A procedure well-known from the state of the art is the steerable horizontal drilling technology (flush drilling method, horizontal directional drilling (HDD). With this three-phase procedure (pilotbore, reaming pass, pull in or pullback step) only pipeline of high tensile strength (e.g. made of steel, PE or casting) can be laid. The geometrical laying output may be over 2.000 m in length and the attainable pipe diameters are maximally approx. 1,400 mm.

Although the steerable horizontal drilling technology has been proven world-wide as a reliable laying method in suitable grounds, there are nevertheless ecological, technical, and economical disadvantages associated with this method.

On both sides of the obstacle to be undercrossed large work surfaces (some thousand square meters) are necessary (so called (rig site and pipe site). These surfaces in particular in ecologically sensitive areas, are not always present or may have an adverse negative influence on the environment.

A further well-known method is microtunneling (MT). A steered, possibly curved, bore is typically produced from a starting pit or a starting excavation to a goal pit or a goal excavation. Characteristic to this method is that pilotbore, reaming pass, pull in or pullback step of the pipes are accomplished in one work step. This combined work step is accomplished in principle by pushing or pressing from the pit or the starting excavation. The drilling pipes, which are also the production pipes, are not tensily connected. With the MT procedure drilling lengths over 500 m and borehole diameters of more than 2,000 mm can be achieved.

A further disadvantage of this method is e.g. that the pushing pipes usually made of concrete remain in the bore causing high costs for the production of the bore. The use of steel or PE-pipes with MT is in principle possible but unusual due to the technical difficulties connected therewith. PE-pipes e.g. have a low compressive strength limiting directly the possible drill length. Steel pipes are axially highly strainable but have to be attached one by one by welding in the starting area. Therefore applications such as high pressure pipelines as an oil or a gas pipeline are typically not possible.

SUMMARY OF THE INVENTION

The object of the present invention is to present a method and a device allowing a trenchless laying of pressure pipelines especially is situations with adverse ecological and/or economical conditions, and substantially overcoming the before mentioned disadvantages.

Referring to FIGS. 2*a*, 2*b*, 2*c* and 4 the invention is a method for laying pipes comprising the steps of constructing a bore hole along a given bore line (7) and laying a pepeline (8) prefabricated into one piece in one work step, wherein the necessary contact forces for drilling and laying are transferred to the drilling device (6) via the pepeline (8); connecting the front end of the pepline (8) with a steerable drilling device (6) preferably connected with the pipeline (8) via a conneting module (15); applying of forces from the outside to the pipeline (8) via traction preferably fiction by a pipe thrusting device (5) pushing the pipeline (8) from a starting point (1) to a goal point (3); removing the cuttings produced during the drilling and transporting them hydraulically out of the bore hole (12); and filling the annular space between pipeline (8) and bore hole wall (11) created during drilling continuously with a liquid. Referring to FIG. 4, in certain aspects of the invention. the drilling device (6) is steerable, wherein at its front face a drill head is provided with a cutting tool (14), wherein at its rear face a connecting module (15) for connecting with a pipeline (8) is provided and wherein the rear face of the drilling device (6) is provided with a cutting ring (16), wherein the driving of the cutting tool (14) and/or the cutting ring (16) is done by at least one insitu drive, and wherein preferably the cutting tool (14) and the cutting ring (16) are separately drivable.

By laying the pipeline in one piece which is both production and product pipeline a quality inspection can be conducted before laying since the pipeline is already assembled in whole prior to laying it. It is possible to conduct pressure tests and especially tests of the joints as well as the coating and the sheathing of the joints. Due to the method of the present invention it is possible to lay a certified and tested product pipeline quickly and cost-effectively.

In certain embodiments, the pipeline (8) has an outside diameter of at least 400 mm and/or the outside diameter of the drilling device (6) is larger than that of the pipeline (8). Thus it is additionally guaranteed that the sheathing and the coating stressed is minimized.

In a preferred embodiment, the drilling step and the laying step are conducted simultaneously and mainly continuously which allows a fast and cost-effective laying since changeover times can almost entirely be avoided compared to microtunneling where changeover can be 50% of the operating time of a drill and laying rig.

In another embodiment, the invention is a drilling device wherein the drilling device (6) is steerable; wherein at its front face a drill head is provided with a cutting tool (14); wherein at its rear face a connecting module (15) for connecting with a pipeline (8) is provided and wherein the rear face of the drilling device (6) is provided with a cutting ring (16); wherein the driving of the cutting tool (14) and/or the cutting ring (16) is done by at least one in-situ drive; and wherein preferably the cutting tool (14) and the cutting ring (16) are separately drivable. Such a device is advantageous in that in case of a necessity to pullback the pipeline during drilling due to ground problems, ground falling in or diameter reduction of the bore, damage of the pipeline can be prevented due to the cutting ring. Furthermore, the advantageous separately present in-situ drives of the cutting tool and the cutting ring allow an optimal adaptation of the individual driving parameters in each direction.

In a preferred embodiment the outside diameter of the cutting ring (16) is slightly smaller than the outside diameter of the drill head and its inside diameter is slightly larger than the inside diameter of the connecting module (15). such an arrangement allows an optimal locating of the cutting ring at the drilling device and a optimal usage of the cutting ring when using the drilling device to perform the method of the invention. In another embodiment, the steerable drilling device (6) is made out of at least two connected modules (13) the modules being connected flexible by at least three steering cylinders. In some versions of the invention, a crusher is integrated in the first module (13) of the drilling device (6), which allows a better transport of the cuttings since the cuttings after crushing are homogenised in size. In other versions high pressure nozzles are adapted at the cutting tool (14) and/or the cutting ring (16) of the drilling device (6) out of which drilling suspension is pumped with high pressure, while for the cutting ring (16) preferably while pulling back. This arrangement, allows for a very efficient and, according to material and wear costs, cost-effective ground cutting during drilling. The filling of the annular space between the wall of the bore and the pipeline causes the bore to be kept open but also causes lubrication between bore and coating or sheathing of the pipeline so the pipeline can be laid with less force and more cost-effectively during the drilling process.

In a preferred embodiment of method of the invention a pipeline is laid from a starting point to a goal point undercrossing an obstacle wherein the drilling of the bore and the pipe laying of the pipeline being prefabricated into one piece on the surface is done in one work step while at the front end of the pipeline a drilling device is present wherein a pipe thruster is located near the starting point creating a pushing force thrusting the pipeline from starting to ending point, while at the same time the necessary contact pressure for drilling is provided. The ground excavated during the drilling is hydraulically transported out of the bore via a transport line inside the pipeline, wherein the annular space between pipeline and bore hole wall created during drilling is continuously filled with an adequate drilling suspension.

A combination of these features is not provided by the existing methods.

Therefore, using the method of the invention allows prefabricated (pressure-) pipelines to be laid into the ground in one piece in ecologically and economically optimized conditions.

BRIEF DESCRIPTION OF THE DRAWINGS

The invention is described further with the following preferred embodiments. The drawings show in FIG. 1 a schematic description of the principle usage possibilities of the inventive method showing in part a) a bore line from a starting pit to a goal pit undercrossing an obstacle, b) a bore line from a starting pit to a goal shaft undercrossing an obstacle, c) a bore line from a starting pit to a goal pit undercrossing a shore line to a goal point on the bottom of the body of water, FIG. 2 a principle description of the method of the invention with a bore line starting in a starting pit undercrossing an obstacle to a goal pit, showing in part a) a principle description of the mounting of the drilling device to the prefabricated pipeline, b) a principle description of the laying of the pipeline, c) a principle description of reaching the goal point with the drilling device, d) a principle description of the pullback, the dismounting of the drilling device as well as shortening of the pipeline at the starting point if applicable, FIG. 3 a principle description of the method of the invention with a bore line starting in a starting pit undercrossing a shore line to a goal point on the bottom of the body of water, showing in part a) a principle description of the mounting of the drilling device to the prefabricated pipeline, b) a principle description of the laying of the pipeline, c) a principle description of reaching the goal point with the drilling device, d) a principle description of the pullback, the dismounting of the drilling device as well as shortening of the pipeline at the starting point if applicable, FIG. 4 a principle description of the essential machine components of the method of the invention.

DETAILED DESCRIPTION OF THE INVENTION

In the following the method of the invention as well as the devices used for typical cases are described exemplary and in detail.

Example 1

In the first example (see FIG. 2*a*-2*d*) there is a starting point 1 in a starting construction pit 2 and the goal point 3 in a goal construction pit 4.

Figure 1A:
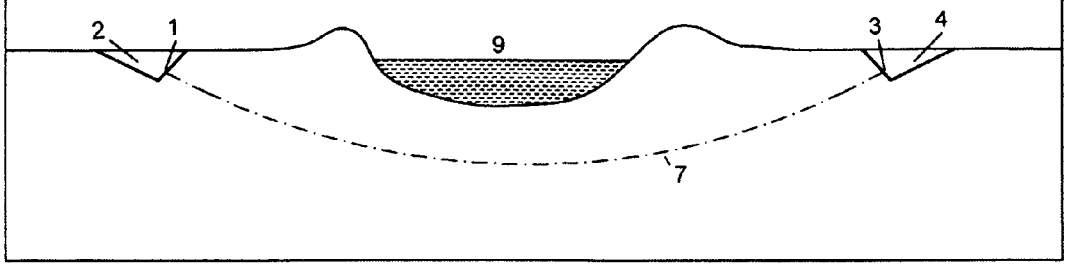
Figure 1B:
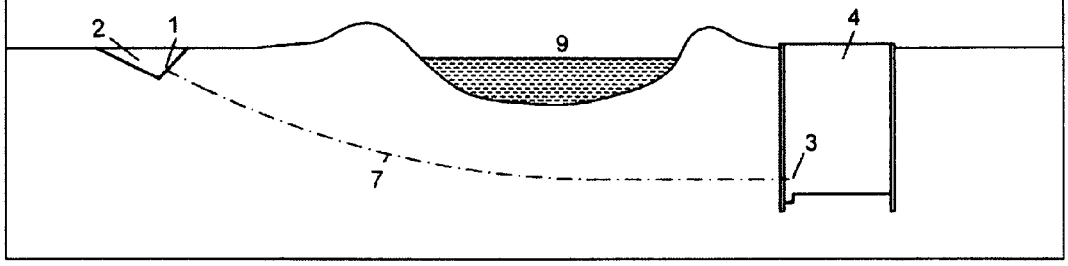
Figure 1C:
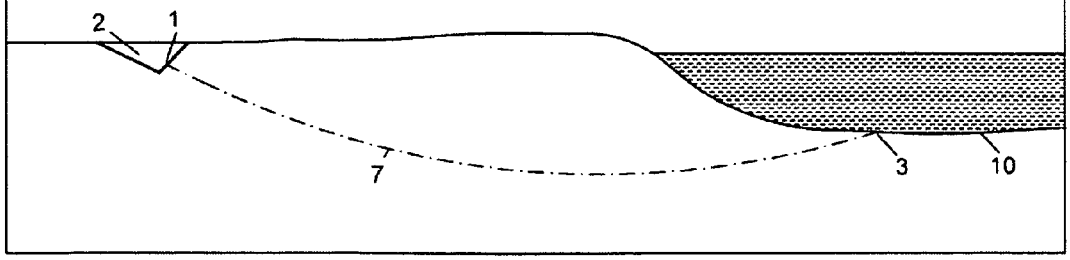
Figure 2A:
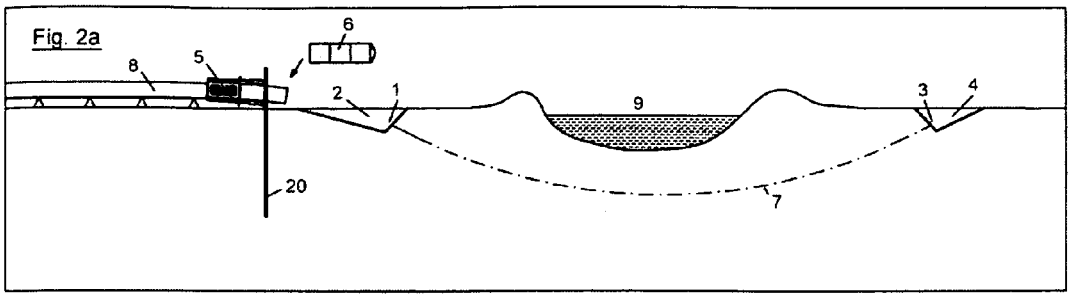

First in the starting construction pit 2 a drilling device 6 is prepared and connected with the pipeline 8. At the same time a pipe thruster 5 is positioned and anchored. The drilling device 6 is primarily a common microtunneling drilling device or a pipe advancing device (FIG. 2*a*).

A pipeline in this application is a line of pipes transporting a product like gas or oil even under high pressure conditions in contrast to a line supporting a borehole as in microtunneling, or advancing pipes or drilling rods.

Figure 2B:
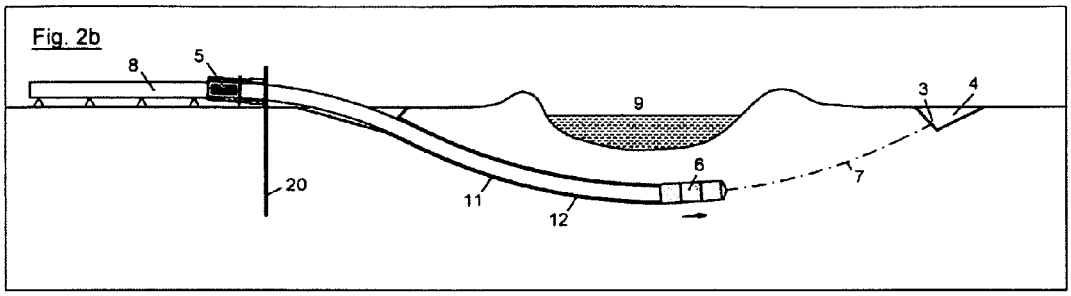

With the use of the drilling device 6 a bore hole along a bore line 7 is constructed underneath an obstacle 9 wherein the drilling device 6 is loaded with the necessary contact pressure by a pipe thruster 5 via the pipeline 8. The determination of the position of the drilling device 6 and the steering of the same along the given bore line is done with common techniques of steerable pipe advancing or directional drilling (FIG. 2*b*).

Figure 2C:
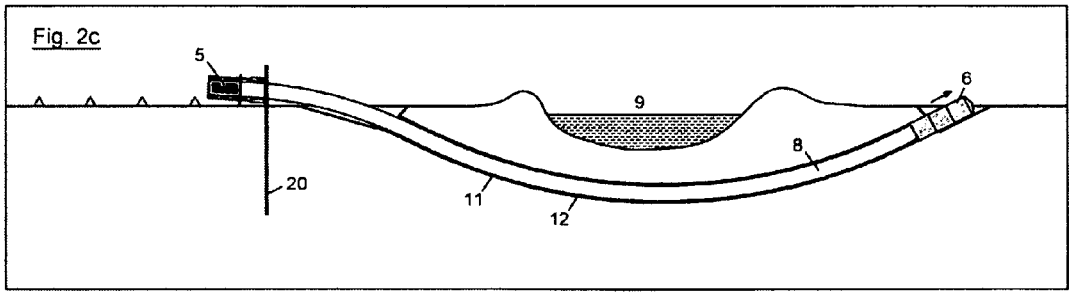

The drilling process along the bore line 7 is continued until the drilling device 6 has reached the goal point 3 in the goal construction pit 4 (FIG. 2*c*).

Figure 2D:
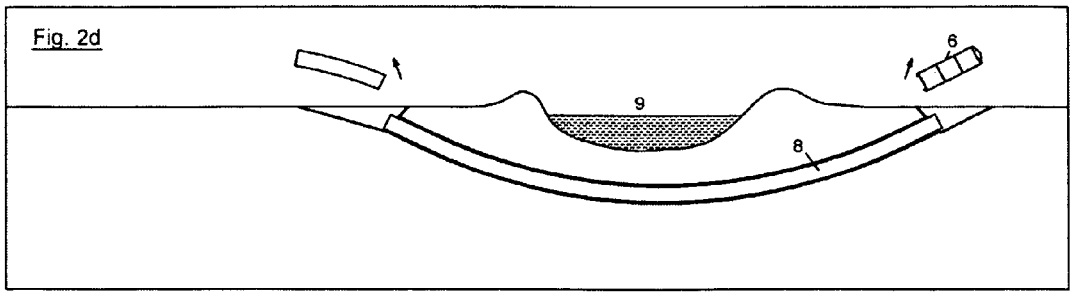

As finishing work steps the drilling device 6 is dismounted from the pipeline 8 and the pipe thruster 5 is dismounted and removed. If necessary the pipeline 8 is shortened in the area of the starting construction pit 2 (FIG. 2*d*).

Example 2

In the second example (see FIG. 3*a*-3*d*) there is a starting point 1 in a starting construction pit 2 and the goal point 3 in a goal construction pit 4.

Figure 3A:
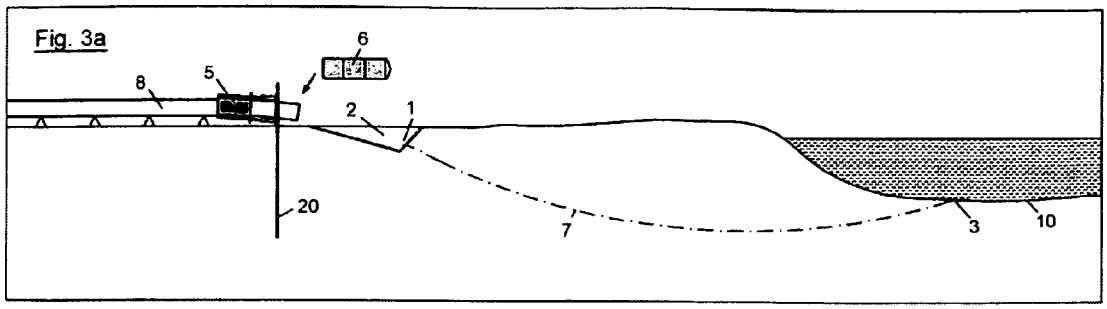

First in the starting construction pit 2 a drilling device 6 is prepared and connected with the pipeline 8. At the same time a pipe thruster 5 is positioned and anchored. The drilling device 6 is primarily a common microtunneling drilling device or a pipe advancing device (FIG. 3*a*).

Figure 3B:
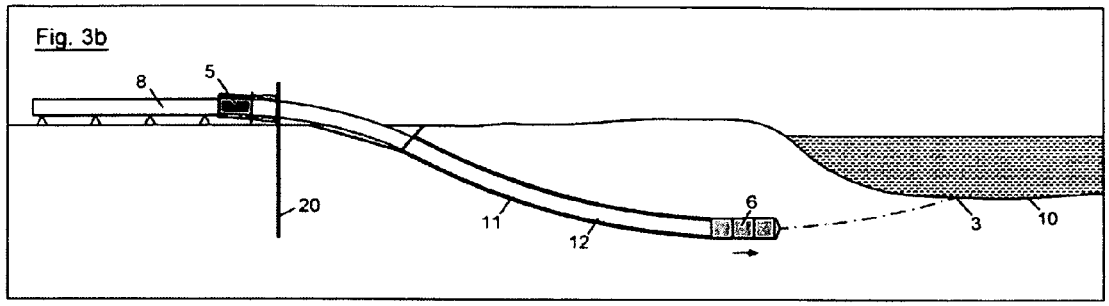

With the use of the drilling device 6 bore hole along a bore line 7 is constructed underneath an obstacle 9 wherein the drilling device 6 is loaded with the necessary contact pressure by a pipe thruster 5 via the pipeline 8. The determination of the position of the drilling device 6 und the steering of the same along the given bore line is done with common techniques of the steerable pipe advancing or directional drilling (FIG. 3*b*).

Figure 3C:
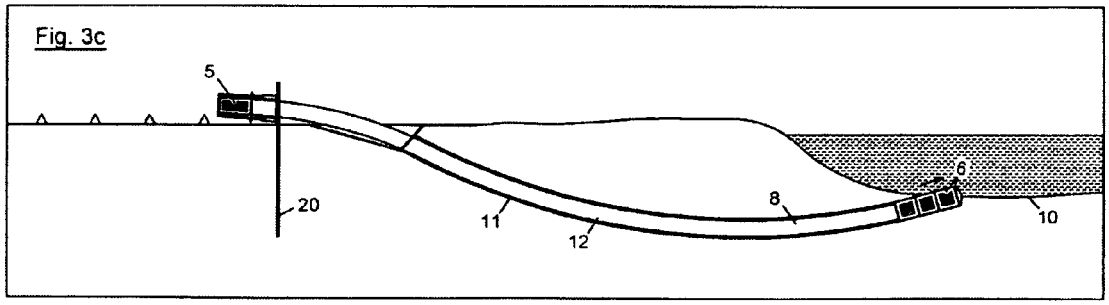

The drilling process along the bore line 7 is continued until the drilling device 6 has reached the goal point 3 on the floor of the waters 10 (FIG. 3*c*).

Figure 3D:
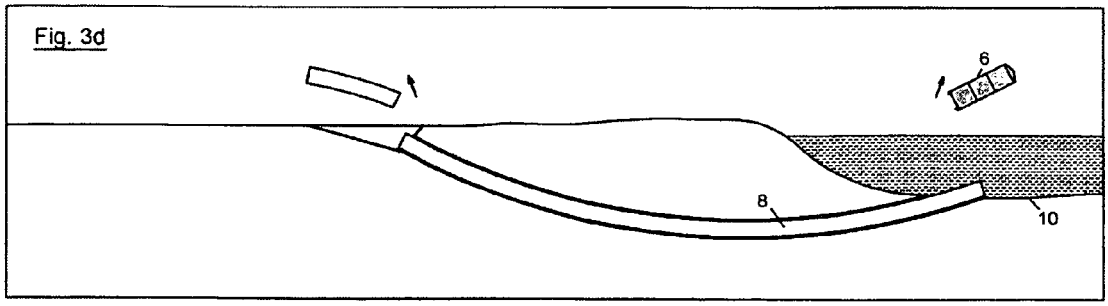

As finishing work steps the drilling device 6 is dismounted from the pipeline 8 and the pipe thruster 5 is dismounted and removed. If necessary the pipeline 8 is shortened in the area of the starting construction pit 2 (FIG. 3*d*).

Example 3

Figure 4:
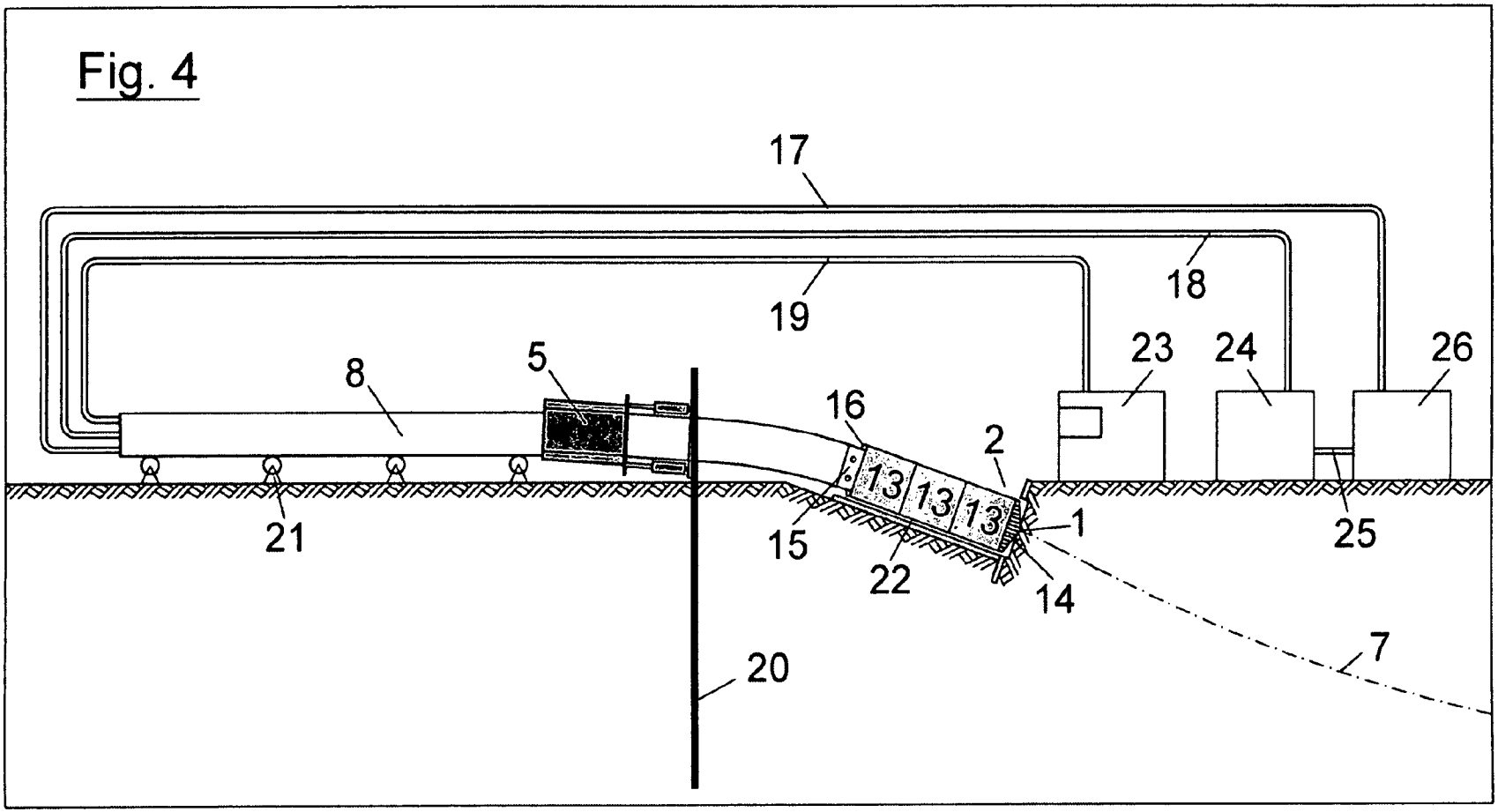

In the third example (see FIG. 4) the essential technical machine components of the method of the invention are presented where in a starting construction pit 2 the drilling device 6 made out of separate modules 13 is mounted onto a guiding frame 22. Positioned on the front module is the cutting wheel 14 with high pressure nozzles as cutting tools and positioned at the read module is the cutting ring 16 which is centrically positioned around a connecting module 15.

The free end of the connecting module 15 is connected in a way guaranteeing compressive and tensile strength with the prefabricated pipeline 8 which is positioned on roller blocks 21. Positioned close to the starting construction pit 2 is a pipe thruster 5 taking in the necessary forces of the drilling and pipe laying processes and diverting them into the ground.

The feeding and steering of the drilling device 6 is conducted via the energy and steering cables 19, the feeder line 18 (for feed fresh drilling suspension to the cutting wheel) as well as the transport line 17 (for transport of the suspension loaded with cuttings out of the bore hole). All steering and supply lines or cables run within the pipeline 8 and are removed after reaching the goal point 3.

Outside the pipeline 8 the energy and steering cables 19 are connected with the control stand with an energy supply 23. The feeder line 18 connects the bore suspension mixing facility with a pump 24 with the drilling device 6 transporting fresh suspension while the transport line ends in the bore suspension processing facility 26. There the suspension is cleaned of the cuttings and the again fresh suspension is transported via a connecting line 25 to the bore suspension mixing facility with pump 24 (suspension circle). Via openings provided at the connecting module 15 the fresh suspension is transported into the annular space between the Pipeline 8 and the bore hole. Alternatively, the suspension loaded with the cuttings can be transported back to the bore suspension processing facility inside the annular space.

The invention claimed is:

1. A method for trenchless pipe laying from a starting point to an endpoint, undercrossing an obstacle, comprising:

prefabricating a pressurized pipeline in one piece in a length equal to or greater than a desired boreline;

connecting the pipeline to a pipe thruster and a steerable drilling head whose head diameter is greater than the pipeline diameter;

drilling a borehole and laying the pipeline into the borehole by applying contact forces to the drilling head by the pipeline as the pipeline is pushed into the borehole by the pipe thruster;

steering the steerable drilling head along the desired boreline;

transporting excavated ground hydraulically via a line inside the pipeline; and, filling continuously annular space between the bore hole and the pipeline with a drilling suspension.

2. The method of claim 1 wherein the pipeline has an outside diameter of at least 400 mm.

3. The method of claim 1 further comprising integrity testing the prefabricated pipeline before drilling and laying.

* * * * *